United States Patent [19]

Kuepper et al.

[11] Patent Number: 4,940,192

[45] Date of Patent: Jul. 10, 1990

[54] PACKAGE TRANSPORT APPARATUS FOR A TEXTILE MACHINE

[75] Inventors: Wilhelm Kuepper; Heinz Kamp, both of Wegberg, Fed. Rep. of Germany

[73] Assignee: W. Schlafhorst & Co., Fed. Rep. of Germany

[21] Appl. No.: 330,627

[22] Filed: Mar. 30, 1989

[30] Foreign Application Priority Data

Mar. 30, 1988 [DE] Fed. Rep. of Germany ..... 3810785

[51] Int. Cl.[5] ..... B65H 67/06

[52] U.S. Cl. ..... 242/35.5 A; 198/465.2

[58] Field of Search ..... 242/35.5 A, 35.5 R; 198/465.2, 608

[56] References Cited

U.S. PATENT DOCUMENTS 1,352,718 9/1920 Ayars ..... 198/608 X
3,065,842 11/1962 Nowak, Jr. ..... 198/608 X
4,463,909 8/1984 Kiriake et al. ..... 242/35.5 A
4,561,536 12/1985 Weaver et al. ..... 198/608 X
4,566,644 1/1986 Kiriake ..... 242/35.5 A
4,586,668 5/1986 Mori ..... 242/35.5 A

*Primary Examiner*—Stanley N. Gilreath
*Attorney, Agent, or Firm*—Shefte, Pinckney & Sawyer

[57] ABSTRACT

A transport means for transporting packages at a winding machine to a plurality of stations for unwinding the packages is provided. The transport means includes a plurality of generally horizontally disposed, partially overlapping, package-supporting plates arranged in a sequential series and means for moving each plate about a generally vertical axis. The surface of each plate moves through an advancing path and transversely of the winding machine through an unwinding station. The packages are individually supported on the package supporting plates for circulation through the unwinding station.

14 Claims, 2 Drawing Sheets

PACKAGE TRANSPORT APPARATUS FOR A TEXTILE MACHINE

BACKGROUND OF THE INVENTION

The present invention relates to an apparatus for transporting packages along a textile machine of the type having a plurality of stations at which yarn packages are unwound.

Known transport apparatus for transporting yarn packages to stations of a textile machine for unwinding thereat suffer from several known disadvantages such as, for example, difficulties in coordinating the movement of the various components of the transport apparatus, excessive breakdown periods and relatively costly, complex and involved systems.

SUMMARY OF THE INVENTION

The present invention provides a transport apparatus, designed to overcome the above-noted disadvantages of the known transport apparatus, which has a relatively simple structure for consistent, problem-free operation.

Briefly described, the present invention provides a transporting means for use in a textile machine of the type having a plurality of stations at which yarn packages are unwound and wherein packages to be unwound are transported in an advancing path along one side of the machine to the stations. The transporting means includes a plurality of generally horizontally disposed, partially overlapping, package supporting plates arranged in a sequential series and means for moving each plate about a generally vertical axis. The surface of each plate moves along the one side of the machine through the advancing path and transversely of the machine through an associated station. Each plate partially overlaps the adjacent plate in the direction of package advance with the overlap extending through a portion of the package advancing path in advance of the station associated with the overlapping plate for selective transfer of advancing packages from one plate to the next along the package advancing path.

According to one aspect of the present invention, the package advancing path extends along one side of the machine and unwound package tubes are transported in a return path from the stations along the other side of the machine and the surface of each plate moves through the return path, the overlap extending through a portion of the tube return path for transfer of returning tubes from one plate to the next.

The transporting means preferably includes means for confining packages in the advancing and returning paths in arcuate segments concentric with the plates. Additionally, the confining means confines the packages through the stations in arcuate continuations of the arcuate segments.

The transporting means preferably includes plate moving means which rotates all of the plates synchronously in a single rotational direction that is the same direction as the direction of advance of the packages. In one embodiment, the transporting means includes moving means which oscillates the plates and means for slidingly supporting the packages on the plates for sliding advance of packages in response to oscillation of the plates.

DETAILED DESCRIPTION OF THE PREFERRED EMBODIMENTS

Figure 2:
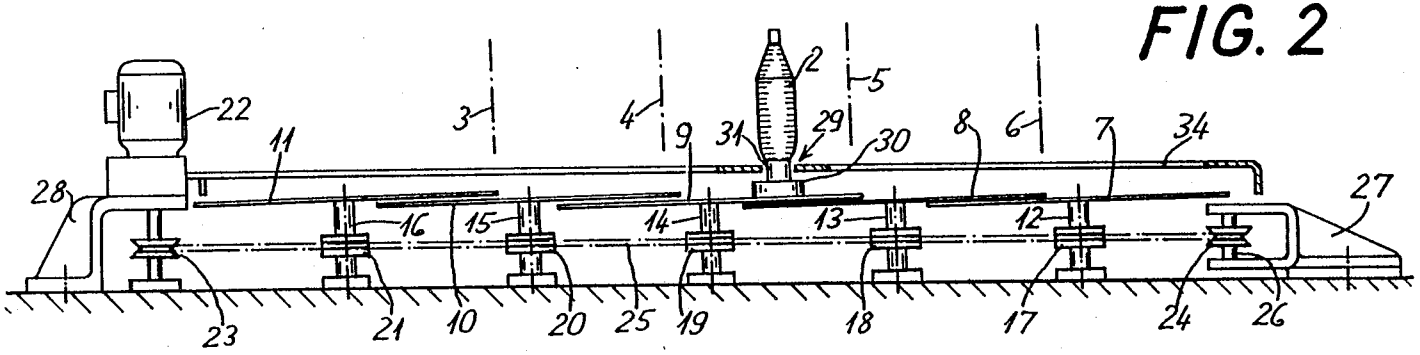
FIG. 2 is a vertical sectional view of the transporting apparatus shown in FIG. 1.
Figure 1:
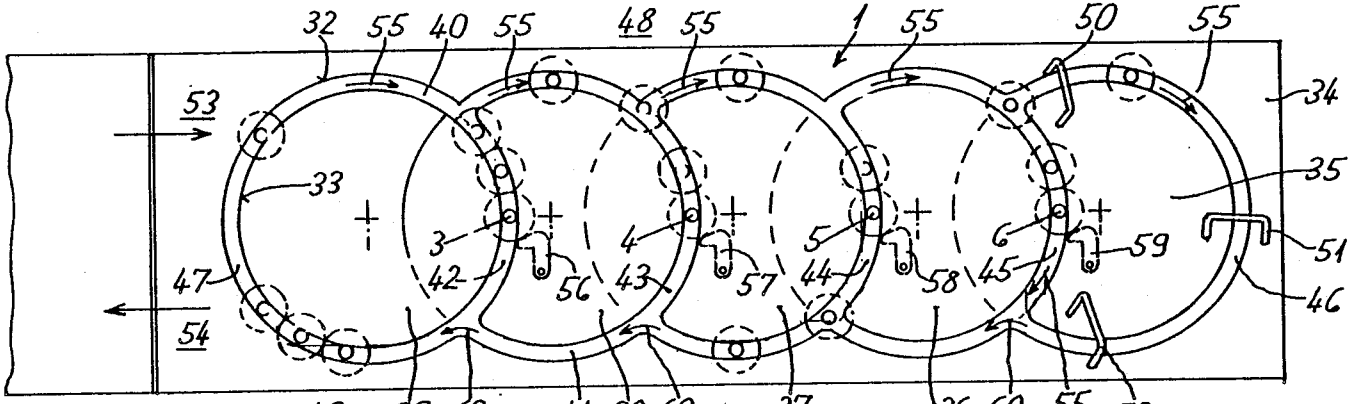
FIG. 1 is a top plan view of one embodiment of the transporting apparatus of the present invention.

As illustrated in FIGS. 1 and 2, one embodiment of the transporting apparatus of the present invention is shown. The transporting apparatus is adapted to transport a plurality of packages 2 of yarn wound on tubes from an automatic winding machine or the like (not shown) along an advancing path 40 along one side of the machine to a plurality of unwinding stations 3, 4, 5 and 6 for unwinding of the packages 2 thereat and aong a return path 41 for the return of unwound tubes. A plurality of generally horizontally disposed, partially overlapping package supporting plates 7, 8, 9, 10 and 11 are arranged in a sequential series and are each respectively mounted on a generally vertical shaft 12, 13, 14, 15 and 16. Each shaft 12, 13, 14, 15 and 16 has a drive means takeoff device, such as a sprocket 17, 18, 19, 20 and 21, respectively, coaxially fixedly mounted thereto and each shaft is rotatably supported on a surface for rotation about its axis. The sprockets 17, 18, 19, 20 and 21, are each drivingly connected to a sprocket 23 of a drive motor 22 by a drive chain 25 extending between the sprocket 23 and an idler sprocket 24. The drive motor 22 is mounted on a bracket 28 and the bracket 28 is secured to the surface on which the shaft 12, 13, 14, 15 and 16 are rotatably mounted. The idler sprocket 24 is mounted on a shaft 26 which is rotatably supported by a bracket 27 mounted to the surface.

The package supporting plates 7, 8, 9, 10 and 11 are cooperatively arranged with one another such that each package supporting plate partially overlaps the adjacent plate in the direction of package advance with the overlap extending through a portion of the package advancing path in advance of the station associated with the overlapping plate. Additionally, each plate moves through the return path 41 and the overlap extends through a portion of the return path for transfer of returning package tubes from one plate to the next. Specifically, package supporting plate 8 partially overlaps package supporting plate 7; package supporting plate 9 partially overlaps package supporting plate 8; package supporting plate 10 partially overlaps package supporting plate 9 and package supporting plate 11 partially overlaps package supporting plate 10. The package supporting plates overlap one another by an extent up to two-thirds of the radius of the plates.

The package supporting plates 7, 8, 9, 10 and 11 are synchronously rotated in a forward direction and may also be reversibly rotated in a reverse direction by the driving rotation of the drive chain 25 by the drive sprocket 23. Each package supporting plate is adapted to support a plurality of package support means 29 each having a cylindrical footing 30 and a centrally mounted post 31 secured thereto on which one of the packages 2 is inserted to be supported thereby. The package support means 29 are shaped conventionally to accommodate sliding from one package supporting plate to an overlapping adjacent plate along the return path. For example, each package support means 29 can be provided with a beveled lower circumferential edge similar to those of the package support members disclosed in U.S. Pat. No. 4,747,482 to Sanno, German Offenlegungsschrift 37 13 135 and German Offenlegungsschrift 37 31 497.

A means for confining the packages 2 to the advancing path includes a generally flat, rectangular border plate 34, the border plate 34 having an opening and secured to the support surface above the packge supporting plates 7–11, and a plurality of generally flat internal plates 35, 36, 37, 38 and 39 supported from the border plate 34 in generally planar relation with the border plate 34 and extending generally parallel to the support surface. The inner plates 35, 36, 37, 38 and 39 are supported within the opening defined by the border plate 34 by a plurality of support bridges, some of which are shown and designated 50, 51, and 52. Each inner plate 35–39 is compatibly configured with the border plate 34 and the adjacent inner plates to define therebetween arcuate segments 32 and 33 in the advancing and return paths concentric with the package supporting plates.

The width of the arcuate segments 32 and 33 is sufficient to allow the projection therethrough of the posts 31 of the package support means 29 with sufficient clearance between the post 31 projecting therethrough and the borders of the arcuate segments for relatively non-binding movement of the posts 31 along the arcuate segments 32 and 33. The arcuate segments 32 and 33 define the advancing path 40 for constraining the individual package support means 29 to move in the advancing direction, indicated by the arrows 55, in response to rotation of the package supporting plates 7–11 by the drive motor 22. Additionally, the arcuate segments 32 and 33 define the return path 41 for constraining the individual package support means 29 to move in a return direction, indicated by the arrow 60, in response to the rotation of the package supporting plate 7–11 by the drive motor 22.

The confining means additionally defines a plurality of arcuate continuations of the arcuae segments 32, 33, these arcuate continuations being designated 42, 43, 44 and 45. These arcuate continuations are each associated with one of the package unwinding stations 3, 4, 5 and 6 respectively, and each extends between the advancing path 40 and the return path 41. The inner plate 35 and the border plate 34 define an end transition path 46 which interconnects the end of advancing path 40 and the end of the return path 41. The last package supporting plate 7 is a package transition plate located below the transition path 46, which transition plate transits packages from the advancing path 40 transversely of the machine to the return path 41 along the transition path 46 for return of unwound packages that have advanced from plate to plate without passing through any of the unwinding stations.

The advancing path 40 is adjacent one longitudinal edge 48 of the rectangular border plate 34 and the return path 41 is adjacent the other longitudinal edge 49 of the border plate 34. The inner plate 39 and the border plate 34 define therebetween a recirculation path 47 between the other end of the advancing path 40 and the other end of the return path 41.

As can be understood, the advancing path 40, the return path 41, the transition path 46, the recirculation path 47 and the arcuate continuations 42, 43, 44 and 45 collectively define five loops of an interconnected package transport apparatus for transport of the packages 2, supported individually on the individual package support means 29, between the automatic winding machine or the like and the package unwinding stations 3, 4, 5 and 6 and between the package unwinding stations themselves. The package transport apparatus thus provides an enclosed circuit allowing the continuous movement of the individual package support means 29 along the interconnected arcuate segments in response to the rotation of the package supporting plates 7–11. As shown in FIG. 1, a total of 20 individual package support means 29 are circulated by the package transport apparatus of the present invention.

The support bridges 50, 51 and 52 are of sufficient height and width to permit passage therethrough of the packages 2 which are supported on their respective individual package support means 29. The inner plates 36, 37, 38 and 39 are supported by support bridges (not shown) in the same manner as the inner plate 35 is supported by the support bridges 50, 51 and 52 from the border plate 34.

Each package unwinding station 3, 4, 5 and 6 has a stop device 56, 57, 58 and 59, respectively, associated therewith for releasably resisting the movement of the individual package support means 29 disposed in the arcuate continuations 42, 43, 44 and 45. Each stop device 56, 57, 58 and 59 resists the movement of a package 2 supported on its individual package support means 29 for a period sufficient for the package unwinding station to unwind the package or to determine, through sensing means (not shown), that no unwinding or, respectively, further unwinding of the package 2 should occur, whereupon the stop device releases the stop package 2 to allow the package to continue to be transported along the respective feed path to the return path 41.

In operation, packages are loaded onto the package support means 29 at a loading station 53 having conventional devices for loading of the packages 2 onto the individual package support means 29. The package support means with empty tubes or unwound recirculating packages thereon travel along the recirculation path 47 to the loading station. The loading station 53 simply allows those individual package support means 29 already loaded with a package 2 to pass thereby and continue their travel along the advancing path 55.

An unloading station 54 having conventional devices for the unloading tubes from the individual package support means 29 is positioned adjacent the end of the return path 41. The unloading station 54 removes those tubes from their individual package support means 29 which have no more acceptable windings thereon and transports these removed empty tubes in the direction shown by the arrow. On the other hand, the unloading station 54 allows those packages 2 which still have appreciable windings thereon to pass thereby to travel along the recirculation path 47 to the advance path 40 to be recirculated among the unwinding stations 3, 4, 5 and 6.

The package supporting plates 7–11 are continuously driven by the guide motor 22 and effect movement of the individual package support means 29 along the arcuate segments 32 and 33 so that each package 2, which is supported on an individual package support means 29, is eventually guided into one of the arcuate continuations 42, 43, 44 and 45 to one of the package unwinding stations 3, 4, 5 and 6 for unwinding thereat and then to the return path 41 to eventually reach the unloading station 54 at which the tubes with no windings or no more acceptable windings thereon, are removed at the unloading station 54.

The movement of the individual package support means 29 by the package supporting plates 7–11 can be accomplished by continuous rotation of the package supporting pltes in a forward direction or through oscillation of each package supporting plate through an oscillating angle. The oscillation of the package supporting plates can be accomplished by cyclically reversing the rotation of the drive sprocket 23 so that the direction of the drive chain 25 cyclically reverses, thereby cyclically reversing the rotation of each of the package supporting plates synchronously. The oscillating motion of the package supporting plates 7–11 causes relative movement between the individual package support means 29 supported thereon and the package supporting plate as follows. If the package supporting plates are, for example, rotated at a relatively slow rate of rotation, no slipping or other relative movement between the package supporting plates and the individual package support means 29 supported thereon will occur. However, if the direction of the rotation of the plates is reversed in a sufficiently rapid manner, relative movement such as slippage will occur between the individual package support means 29 and the package supporting plates. In the event of such slippage, the individual package support means 29 tend to either remain in their initial relative position on the package supporting plates or move relative to the package supporting plate in the direction opposite to the rate of rotation. Accordingly, relative movement between the individual package support means 29 and the package supporting plates 7–11 can be induced by cyclically reversing the rotation of the package supporting plates 7–11. By oscillating or cyclically reversing the rotation of the package supporting plates, the unwinding of the trailing yarn ends of the packages 2 can be minimized or prevented.

Accordingly, the simultaneous operation of rotating the package supporting plates 7–11 in the same directon or reversedly rotating the package supporting plates with the operation of the loading station 53 and the unloading station 54 creates an operation in which the individual package support means 29 are continuously advanced along the advance path 40 to queue with other individual packages support means with packages thereon along one of the arcuate continuations 42, 43, 44 and 45 or is advanced to the transition path 46 between one end of the advance path 40 and one end of the return path 41. If the individual package support means 29 queues in one of the arcuate continuations 42, 43, 44 or 45, the package 2 supported thereon is evenutally moved into engagement with one of the stop devices 56, 57, 58 or 59 to be releasably held as the package is unwound and the empty tube is thereafter released following the unwinding of the yarn from the package 2 to continue traveling along the feed path to the return path 41, whereupon the individual tubes on their package support means 29 are moved to the unloading station 54.

At the unloading station 54, if the package 2 supported on the individual package support means 29 still has appreciable windings thereon which are suitable for the unwinding process, the unloading station 54 permits the package 2 and the individual support means 29 to move along the transition path 43 to again travel along the advancing path 40. On the other hand, if the tube on the individual support means 29 has no further windings or no more acceptable windings, the unloading station 54 removes the tube therefrom and the now empty individual package support means 29 is permitted to move along the recirculation path 47 to the loading station 53 at which a fresh package 2 is loaded thereon. In this manner, the individual package support means 29 continuously circulates along the advance path 40, the arcuate continuations 42, 43, 44 and 45, the return path 41 and the recirculation path 47, and when necessary through the transition path 46. Due to the configuration of the arcuate continuations 42, 43, 44 and 45, once a predetermined number of packages 2 have queued at the feed path to await unwinding at the associated package unwinding station, additional oncoming packages 2 contact the awaiting packages 2 and are freed thereby to move along the next interval of the advance path 40. Thus, the packages 2 are sequentially moved to the intersection of each arcuate continuation 42, 43, 44 and 45 with the advance path 40 until sufficient room is available for the oncoming package 2. If none of the arcuate continuations has available room, the package 2 is transported from the advance path 40 to the return path 41 along the transition path 46 and eventually passes through the recirculation path 47, past the loading station 53 to begin another cycle of movement along the advance path 40.

In the illustrated embodiment of the package transport apparatus of the present invention, the package supporting plates 7–11 are arranged relative to one another in shingle-like fashion by tilting each of the package supporting plate shafts 12, 13, 14, 15 and 16 at a slight angle relative to vertical. Alternatively, the plates can be arranged in stepwise fashion with each plate horizontally disposed.

In the illustrated embodiment the plates 7–11 are slightly spaced. Alternatively, the package supporting plates 7–11 may be arranged to slide on one another during rotation. Through appropriately positioned supports, the apparatus can be arranged such that the package supporting plates slide relative to one another with reduced force while operating with relatively small loads thereon or can be arranged to rotate in friction-free superposed relation to one another while operating with relatively small loads thereon.

Figure 3:
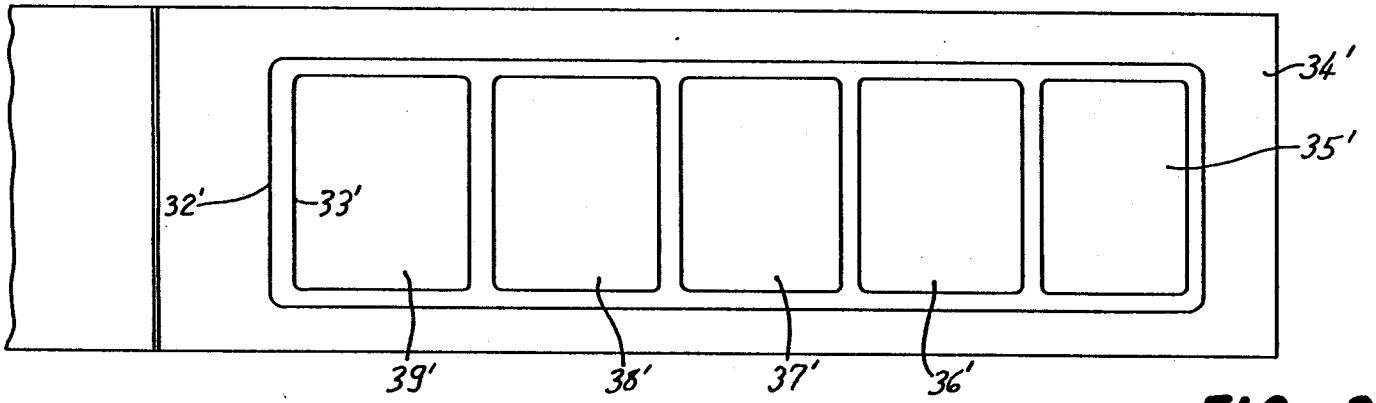
FIG. 3 is a top plan view of another embodiment of the transporting apparatus of the present invention.

Another embodiment of the transporting apparatus of the present invention is illustrated in FIG. 3. The embodiment illustrated in FIG. 3 is identical to the embodiment illustrated in FIGS. 1 and 2 except that it includes a plurality of flat internal plates 35'–39' which are shaped as parallelograms instead of the curved internal plates 35–39 illustrated in FIG. 1. The plates 35'–39' cooperate with the borderplate 34' to define therebetween straight segments 32' and 33' in the straight advancing and return paths and straight transverse paths concentric with the package supporting plates. Each adjacent pair of the plates 35'–39' forms one of the transverse paths therebetween extending between the advancing path and the return path and a respective package unwinding station is located along the transverse path for unwinding of packages delivered thereto by the individual package support means 29.

In operation, individual package support means 29 is moved along the straight advancing path due to the rotation of the respective package supporting plate 7–11 on which it is supported in the direction shown by the arrows 55 in FIG. 1. The package supporting plate causes movement of the respective package support means 29 from the advancing path into a transverse path in which there are not already sufficient package support means to prevent entry as in the embodiment of FIG. 1. The respective individual package support means 29 is then advanced along the transverse path to bring the package 2 supported thereon to the respective package unwinding station on the transverse path for unwinding of the package 2 thereat. Following unwinding of the respective package, the respective individual package support means 29 is advanced by the rotating action of the package supporting plate 7–11 upon which it is supported along the remainder of the straight transverse path and onto the straight return path.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile machine of the type having a plurality of stations at which yarn packages are unwound and wherein packages to be unwound are transported in an advancing path along one side of the machine to the stations, transporting means comprising:

a plurality of generally horizontally disposed, partially overlapping, package supporting plates arranged in a sequential series;

means for moving each plate about a generally vertical axis with the surface of each plate moving along said one side of the machine through said advancing path and transversely of the machine through an associated station, each said plate partially overlapping the adjacent plate in the directon of package advance with the overlap extending through a portion of the package advancing path in advance of the station associated with the overlapping plate for selective transfer of advancing packages from one plate to the next along the package advancing path.

2. In a textile machine, transporting means according to claim 1 and characterized further by means at each of said stations for accumulating packages awaiting unwinding with the last package of an accumulation of a predetermined number of packages being positioned for contact by subsequent packages to be directed thereby along the advancing path onto the adjacent plate.

3. In a textile machine, transporting means according to claim 1 and characterized further by means for confining packages in said path in arcuate segments concentric with said plates.

4. In a textile machine, transporting means according to claim 1 wherein the package advancing path extends along one side of the machine, unwound package tubes are transported in a return path from the station along the other side of the machine, the surface of each plate moves through said return path and said overlap extends through a portion of the tube return path for transfer of returning tubes from one plate to the next and characterized further by means for confining packages in said advancing and return paths in arcuate segments concentric with said plates.

5. In a textile machine, transporting means according to claim 3 and characterized further in that said confining means confines said packages through said stations in arcuate continuations of said arcuate segments.

6. In a textile machine, transporting means according to claim 4 and characterized further in that said confining means confines said packages through said stations in arcuate segments concentrically connecting said advancing path segments and said return path segments.

7. In a textile machine, transporting means according to claim 1 and characterized further by means for confining packages in said path in a straight line, and by means for slidingly supporting said packages on said plates for advance in said straight line as said plates move.

8. In a textile machine, transporting means according to claim 1 wherein the package advancing path extends along one side of the machine, unwound package tubes are transported in a return path from the station along the other side of the machine, the surface of each plate moves through said return path and said overlap extends through a portion of the tube return path for transfer of returning tubes from one plate to the next and characterized further by means for confining packages in said paths in straight lines, and by means for slidingly supporting said packages on said plates for movement through said straight line paths as said plates move.

9. In a textile machine, transporting means according to claim 7 or 8 and characterized further in that said confining means confines said packages for movement in straight lines through said stations transversely between said paths.

10. In a textile machine, transporting means according to claim 1 wherein the package advancing path extends along one side of the machine, unwound package tubes are transported in a return path from the station along the other side of the machine, the surface of each plate moves through said return path and said overlap extends through a portion of the tube return path for transfer of returning tubes from one plate to the next and characterized further by a package transition plate as a last plate of said series of plates and at which there is no package unwinding station, said last plate transiting packages from said advancing path transversely of the machine to said return path for return of unwound packages that have advanced from plate to plate without passing through any of said stations.

11. In a textile machine, transporting means according to claim 1 and characterized further in that said plate moving means comprises means for rotating all of said plates synchronously in a single rotational direction that is the same direction as the direction of advance of packages.

12. In a textile machine, transporting means according to claim 1 and characterized further in that said moving means oscillates said plates and by means for slidingly supporting said packages on said plates for sliding advance of packages in response to oscillation of said plates.

13. In a textile machine, transporting means according to claim 1 and characterized further in that each of said plates is disposed at a slight inclination to accommodate overlapping of adjacent plates.

14. In a textile machine, transporting means according to claim 1 and characterized further in that said means for moving each plate comprises means for reversibly rotating each plate to effect slippage between the plate and the packages supported thereon.

* * * * *